US011352164B2

(12) United States Patent
Barbieri et al.

(10) Patent No.: US 11,352,164 B2
(45) Date of Patent: Jun. 7, 2022

(54) CARTON PACKAGE AND A BLANK FOR A CARTON PACKAGE

(71) Applicant: TETRA LAVAL HOLDINGS & FINANCE S.A., Pully (CH)

(72) Inventors: Marcello Barbieri, Modena (IT); Alberto Mameli, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 17/257,073

(22) PCT Filed: Jul. 26, 2019

(86) PCT No.: PCT/EP2019/070195
§ 371 (c)(1),
(2) Date: Dec. 30, 2020

(87) PCT Pub. No.: WO2020/030446
PCT Pub. Date: Feb. 13, 2020

(65) Prior Publication Data

US 2021/0122515 A1 Apr. 29, 2021

(30) Foreign Application Priority Data

Aug. 6, 2018 (EP) ..... 18187432

(51) Int. Cl.
*B65D 5/06* (2006.01)
*B65D 5/02* (2006.01)

(52) U.S. Cl.
CPC ..... *B65D 5/064* (2013.01); *B65D 5/029* (2013.01)

(58) Field of Classification Search
CPC ..... B65D 5/064; B65D 5/029; B65D 5/067; B65D 5/4266; B65D 5/0209
(Continued)

(56) References Cited

U.S. PATENT DOCUMENTS 3,390,827 A 7/1968 Malby et al.
7,934,637 B2 * 5/2011 Kaneko ..... B65D 5/067 229/125.14

(Continued)

FOREIGN PATENT DOCUMENTS

DE 29602975 U1 6/1996
DE 102016003826 A1 10/2017
EP 3318502 A1 5/2018

OTHER PUBLICATIONS

International Search Report (PCT/ISA/210) dated Oct. 1, 2019, by the Japan Patent Office as the International Searching Authority for International Application No. PCT/EP2019/070195.

(Continued)

*Primary Examiner* — Christopher R Demeree
(74) *Attorney, Agent, or Firm* — Buchanan Ingersoll & Rooney PC

(57) ABSTRACT

A carton package is disclosed comprising a top panel, a bottom panel, a front panel, a back panel, a left panel, and a right panel separated by four edges. The front panel is connected to the top panel along a front-top edge and is connected to the bottom panel along a front-bottom edge. At a first height, measured from the front-bottom edge, the transversal width of the front panel measured from a front-left edge to a front-right edge is larger than a length of the front-bottom edge, and larger than a length of the front-top edge. At a second height measured from the front-bottom edge, the transversal width of the front panel measured from the front-left edge to the front-right edge is smaller than the length of the front-bottom edge, and smaller than the length of the front-top edge.

19 Claims, 8 Drawing Sheets

(58) Field of Classification Search
USPC ..... 229/116.1, 125.42; D9/431; 222/81
See application file for complete search history.

(56) References Cited

U.S. PATENT DOCUMENTS

| | | | | | |
|---|---|---|---|---|---|
| D668,539 | S | * | 10/2012 | Barbieri | D9/431 |
| D677,565 | S | * | 3/2013 | Barbieri | D9/431 |
| D837,050 | S | * | 1/2019 | Moroni | D9/432 |
| D844,430 | S | * | 4/2019 | Dammers | D9/431 |
| D883,797 | S | * | 5/2020 | Ohkura | D9/560 |
| D885,926 | S | * | 6/2020 | Ohkura | D9/560 |
| 10,850,887 | B2 | * | 12/2020 | Dammers | B65D 5/029 |
| D915,196 | S | * | 4/2021 | Gaudiomonte | D9/433 |
| D919,431 | S | * | 5/2021 | Dammers | D9/431 |
| 11,014,703 | B2 | * | 5/2021 | Nakamura | B65D 5/746 |
| D926,570 | S | * | 8/2021 | Engelbrecht | D9/432 |
| 2004/0169066 | A1 | * | 9/2004 | Palm | B65D 5/067 229/110 |
| 2006/0144912 | A1 | * | 7/2006 | Franic | B65D 5/029 229/125.15 |
| 2008/0296359 | A1 | * | 12/2008 | Kortsmit | B65D 5/067 229/136 |
| 2011/0113733 | A1 | * | 5/2011 | Franic | B65D 5/029 53/452 |
| 2012/0279182 | A1 | * | 11/2012 | Barbieri | B65D 5/4266 53/456 |
| 2019/0106239 | A1 | | 4/2019 | Dammers et al. | |

OTHER PUBLICATIONS

Written Opinion (PCT/ISA/237) dated Oct. 1, 2019, by the Japan Patent Office as the International Searching Authority for International Application No. PCT/EP2019/070195.

* cited by examiner

CARTON PACKAGE AND A BLANK FOR A CARTON PACKAGE

TECHNICAL FIELD

The present invention relates to a carton package for liquid consumables and a blank for a carton package.

BACKGROUND

A wide variety of carton packages for liquid consumables are used today to suit a multitude of different products and needs. The configuration and shape of the carton package has impact on several aspects, such as ease of use, both in terms of the handling of the package itself, and how well the properties of the package harmonize with the characteristics of different filling products. The type of product influences, for example, how the package is handled when being opened, or how the product is emptied from the package effectively. For example, remains of a highly viscous product may be more difficult to extract from the package, typically requiring more manipulation of the package itself. It may be difficult for some people with for instance motor skill injuries or elderly people having a lowered muscular capability to empty the package without leaving content in the package that goes to waste. The package is frequently also manipulated upon recycling when the product has been emptied. The shape of the carton package affects mechanical properties such as the rigidity of the package. A tradeoff is typically necessary to find a compromise between ease of handling of the package and its mechanical properties, leading to a sub-optimal overall performance for certain product categories.

SUMMARY

It is an object of the invention to at least partly overcome one or more limitations of the prior art. It is also an object of the invention to provide a carton package and a related blank for a carton package allowing for facilitated gripping of the carton package during use.

In a first aspect of the invention, a carton package for liquid consumables is provided comprising a top panel, a bottom panel, a body extending between the top panel and the bottom panel, the body comprising a front panel, a back panel, a left panel and a right panel separated by four edges: front-left edge, front-right edge, back-left edge and back-right edge. Each of the front panel, back panel, left panel, and right panel and each of the four edges extends from the top panel to the bottom panel. The front panel is connected to the top panel along a front-top edge and is connected to the bottom panel along a front-bottom edge. At a first height, measured from the front-bottom edge, the transversal width of the front panel measured from the front-left edge to the front-right edge is larger than a length of the front-bottom edge, and larger than a length of the front-top edge. At a second height measured from the front-bottom edge, the transversal width of the front panel measured from the front-left edge to the front-right edge is smaller than the length of the front-bottom edge, and smaller than the length of the front-top edge.

In a second aspect of the invention, a carton blank for a carton package is provided, comprising a first longitudinal crease line defining a front-left edge of said carton package, a second longitudinal crease line defining a front-right edge of said carton package, a first transversal crease line defining a front-top edge, a back-top edge, a left-top edge, and a right-top edge of said carton package, a second transversal crease line defining a front-bottom edge, a back-bottom edge, a left-bottom edge, and a right-bottom edge of said carton package. The carton blank comprises a front panel section, a back panel section, a left panel section, and a right panel section. The front panel section extends between the front-left edge and the front-right edge and is connected to a top panel section along the front-top edge and is connected to a bottom panel section along the front-bottom edge. At a first height measured from the front-bottom edge, the transversal width of the front panel section measured from the front-left edge to the front-right edge is larger than a length of the front-bottom edge, and larger than a length of the front-top edge. At a second height measured from the front-bottom edge, the transversal width of the front panel section measured from the front-left edge to the front-right edge is smaller than the length of the front-bottom edge, and smaller than the length of the front-top edge.

Having a transversal width of the front panel section as described above, at the first height and at the second height, provides for an improved and intuitive location at which a user may grip the packaging container, which facilitates handling and manipulation thereof. The packaging container will be balanced in the hand of the user and the force provided by the user's hand will be more evenly distributed around the surface of the packaging container.

Further examples of the invention are defined in the dependent claims, wherein features for the first aspect may be implemented for the second aspect, and vice versa.

Still other objectives, features, aspects and advantages of the invention will appear from the following detailed description as well as from the drawings.

BRIEF DESCRIPTION OF THE DRAWINGS

These and other aspects, features and advantages of which examples of the invention are capable of will be apparent and elucidated from the following description of examples of the present invention, reference being made to the accompanying drawings, in which.

DETAILED DESCRIPTION

Figure 1A:
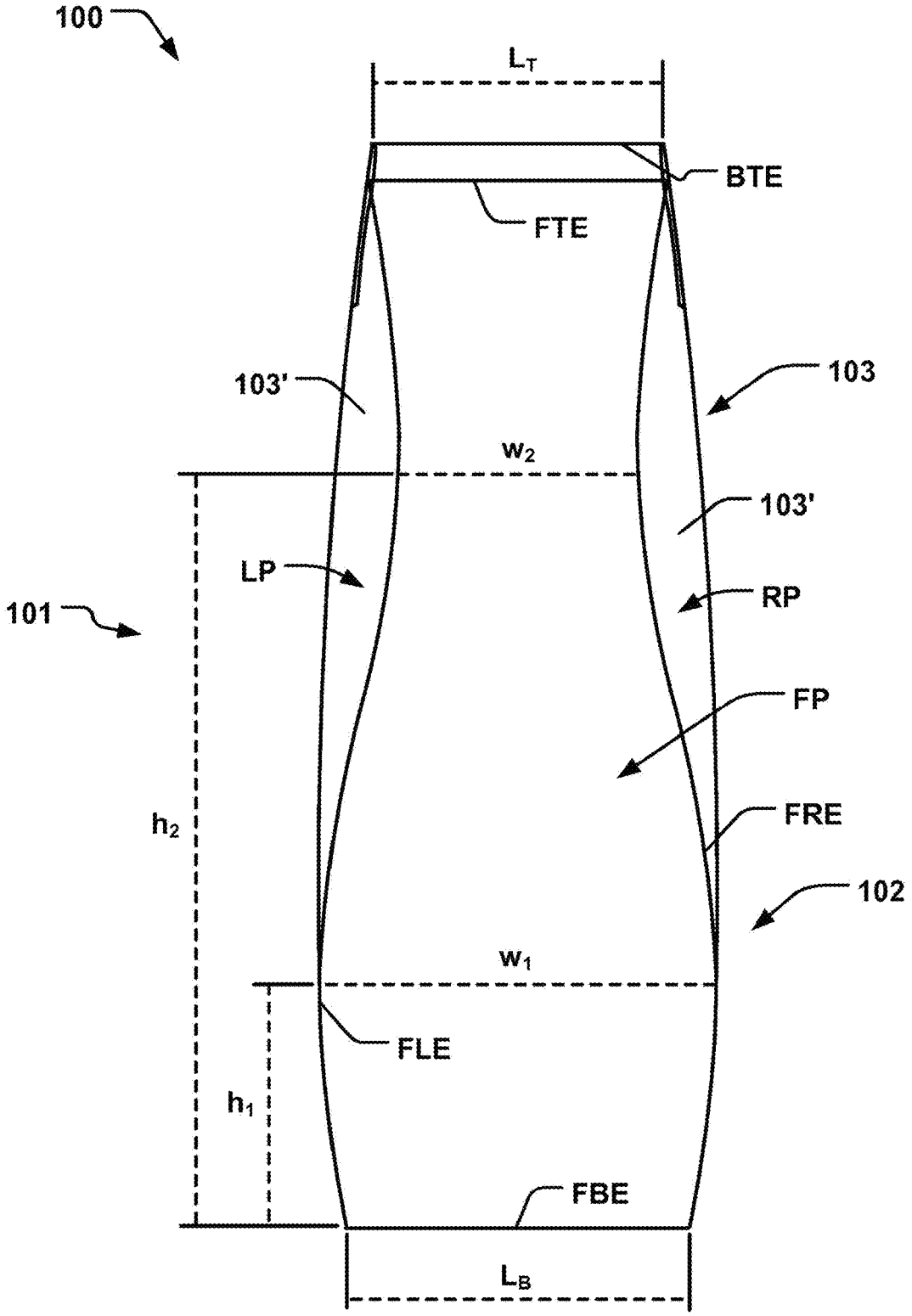
FIG. 1*a* is a schematic front view illustration of a front panel, a left panel and a right panel of a container package, according to examples of the disclosure.

Specific examples of the invention will now be described with reference to the accompanying drawings. This invention may, however, be embodied in many different forms and should not be construed as limited to the examples set forth herein; rather, these examples are provided so that this disclosure will be thorough and complete, and will fully convey the scope of the invention to those skilled in the art. The terminology used in the detailed description of the examples illustrated in the accompanying drawings is not intended to be limiting of the invention. In the drawings, like numbers refer to like elements.

FIG. 1 is a schematic illustration of a carton package 100 for liquid consumables comprising a top panel (T), a bottom panel (B), and a body 101 extending between the top panel (T) and the bottom panel (B). The body 101 comprises a front panel (FP), a back panel (BP), a left panel (LP), and a right panel (RP) separated by four edges: a front-left edge (FLE), front-right edge (FRE), back-left edge (BLE), back-right edge (BRE). Each of the front panel (FP), back panel (BP), left panel (LP), and right panel (RP) and four edges extend from the top panel (T) to the bottom panel (B). The front panel (FP) is connected to the top panel (T) along a front-top edge (FTE) and is connected to the bottom panel (BP) along a front-bottom edge (FBE).

Figure 2:
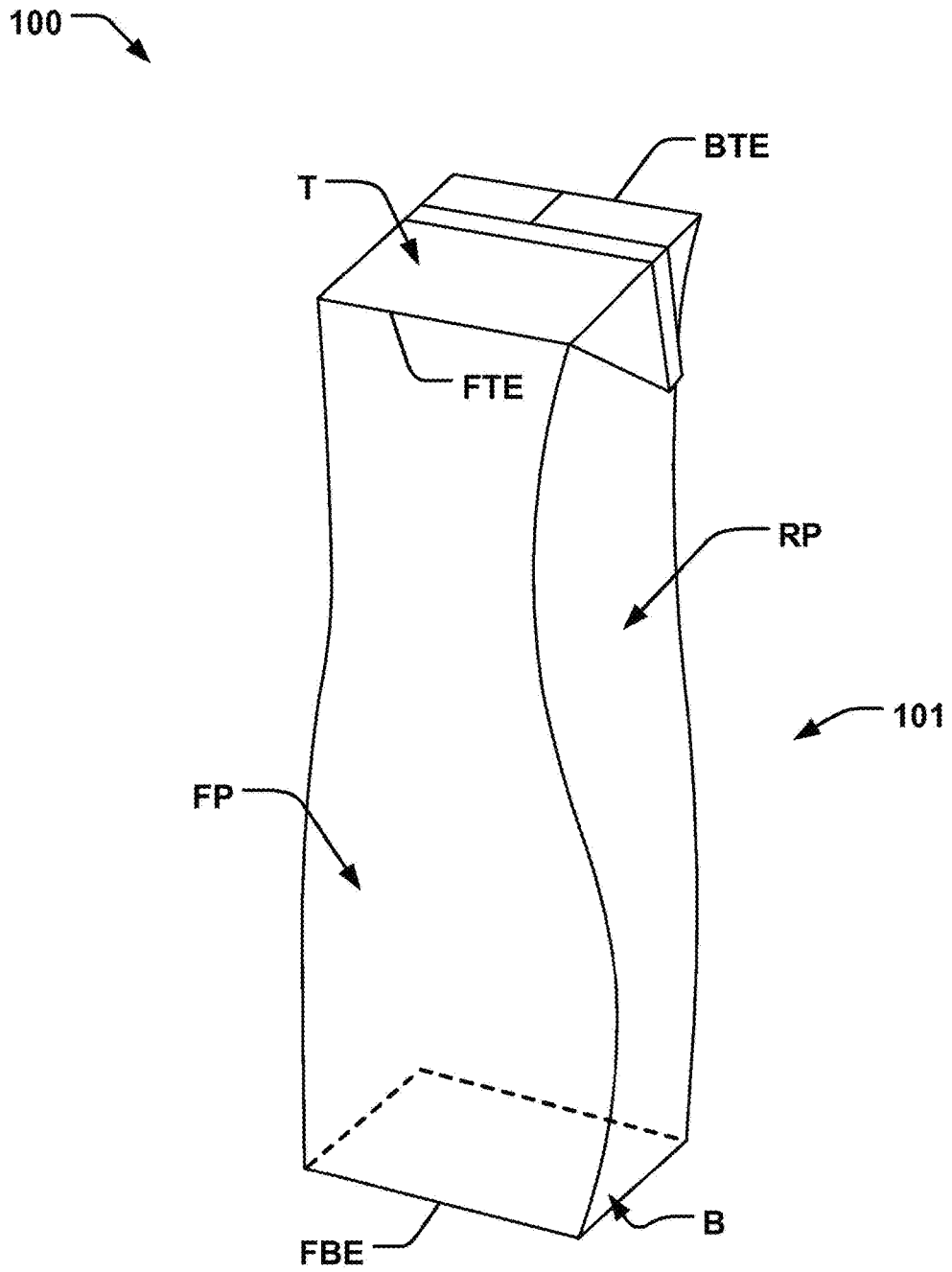
FIG. 2 is a schematic illustration, in a perspective view, of a front panel, a top panel, and a right panel of a container package, according to examples of the disclosure.

FIG. 2 shows a perspective view of the package 100.

Turning again to FIG. 1*a*, at a first height ($h_1$), measured from the front-bottom edge (FBE), the transversal width ($w_1$) of the front panel (FP) measured from the front-left edge (FLE) to the front-right edge (FRE) is larger than a length ($L_B$) of the front-bottom edge (FBE), and larger than a length ($L_T$) of the front-top edge (FTE). At a second height ($h_2$), measured from the front-bottom edge (FBE), the transversal width ($w_2$) of the front panel (FP) measured from the front-left edge (FLE) to the front-right edge (FRE) is smaller than the length ($L_B$) of the front-bottom edge (FBE), and smaller than the length ($L_T$) of the front-top edge (FTE).

This provides for a particularly advantageous shape of the front panel (FP), both in terms of user friendliness and from the standpoint of mechanical properties of the package 100. Having the transversal widths ($w_1$, $w_2$) larger and smaller, respectively, than the lengths ($L_B$, $L_T$) of the front-bottom edge (FBE) and the front-top edge (FTE) provides for a front panel (FP) having a first section 102 and a second section 103, the second section 103 being narrower than the first section 102. The narrow width of the second section 103 provides for an intuitive position at which the user may place his or her hand when quickly engaging to grip the package 100. The grip around the package 100 is further facilitated as the user's hand may more easily conform to the aforementioned second section 103. This also provides for distributing the force that the hand exerts upon the package 100 over a larger surface, thereby allowing for reducing any localized pressure points that may cause discomfort for some users handling heavy packages, while maintaining a sufficient frictional force between the hand and the package 100 for a secure grip. The narrow second section 103 provides also for an indentation at which compression of the package 100 may be initiated in a facilitated manner. This in turn provides for facilitated emptying of the package 100 and compression for recycling purposes. Having a first section 102 with increased width provides for maintaining a given volume and height, such as a standardized height, of the package 100 while being able to emphasize the indentation at the second section 103. The first section 102 provides for maintaining an increased stability of the package 100, while allowing the reduced width ($w_2$) at the second section 103 to provide for facilitated gripping and manipulation of the package 100 as desired. Having a second section 103 of reduced width ($w_2$) allows for having beveled surfaces 103' between the front panel (FP) and the left panel (LP) and right panel (RP), and extending along the front-left edge (FLE) and the front-right edge (FRE), as schematically illustrated in FIG. 1*a*. A beveled surface should be construed in the ordinary meaning of the term, i.e. beveled surfaces 103' does not form a right angle to the front panel (FP). The width of the beveled surfaces 103' may be widest at height $h_2$ where the width ($w_2$) of the front panel (FP) is the smallest. The width of the beveled surfaces 103' may then decrease gradually towards the top panel (T) and the first section 102 as illustrated in FIGS. 1*a* and 1*n* FIG. 2. The beveled surfaces 103' provides for facilitating gripping of the package 100 and manipulation of the package 100, such as compressing the package at the second section 103.

The second height ($h_2$) may be greater than the first height ($h_1$), as illustrated in the example of FIG. 1*a*. The consumer may accordingly conveniently grip the second section 103 at the upper part of the package 100 where the width ($w_2$) is reduced relative to the width ($w_1$) at the first section 102 which instead provides for a robust lower base of the package 100 as well as improved control of the package 100 when pouring the content from an opening thereof, e.g. avoiding a top-heavy package 100 when being gripped.

Figure 1B:
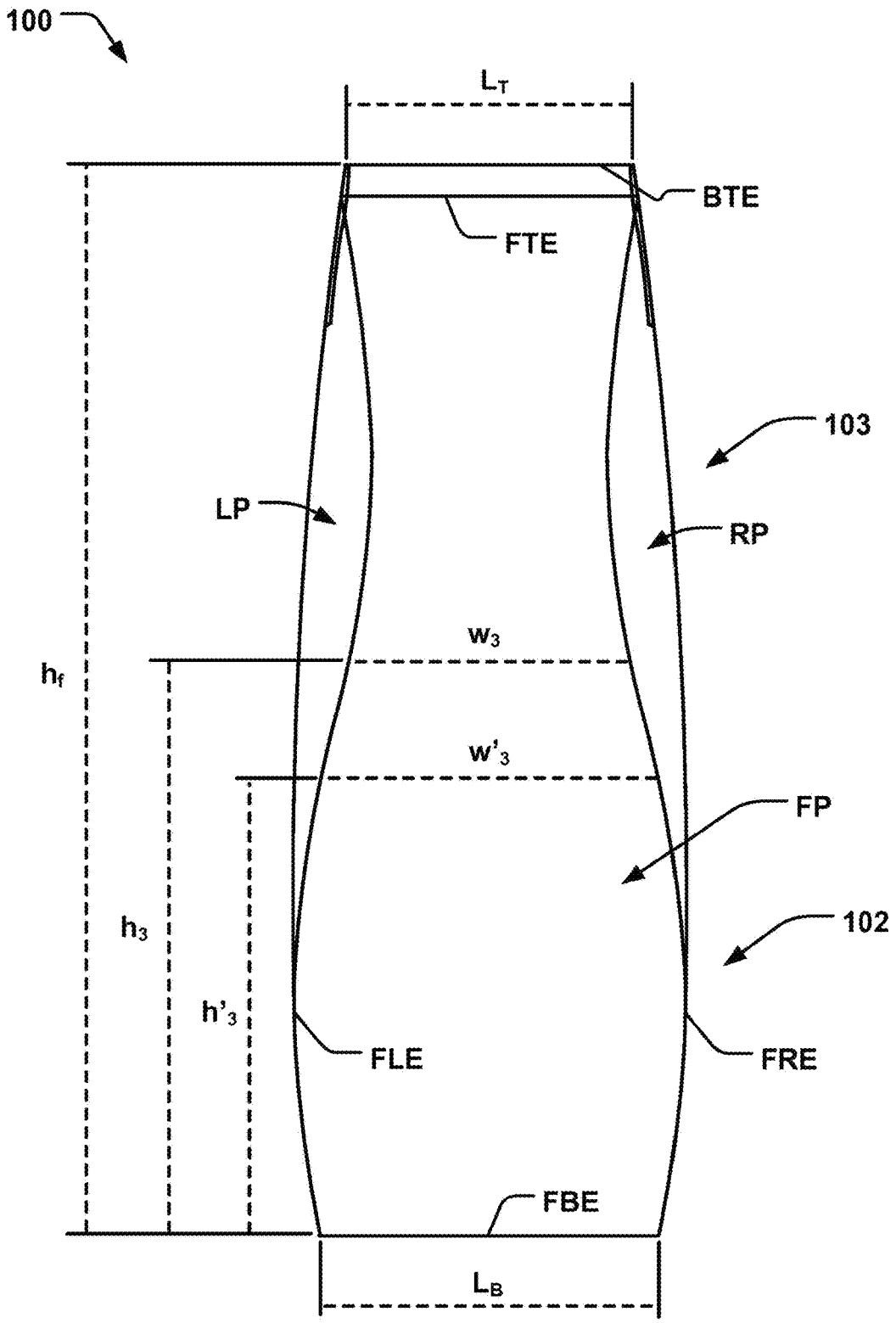
FIG. 1*b* is a schematic front view illustration of a front panel, a left panel, and a right panel of a container package, according to examples of the disclosure.

A transversal width ($w_3$, $w'_3$) of the front panel (FP) may be equal to the length ($L_B$) of the front-bottom edge (FBE) or to the length ($L_T$) of the front-top edge (FTE) at a height ($h_3$, $h'_3$). This is schematically illustrated in FIG. 1*b*, where the width $w'_3$ is equal to the length $L_B$ at a height $h'_3$, and the width $w_3$ is equal to the length $L_T$ at a height $h_3$. The ratio $h_3/h_f$, or $h'_3/h_f$, may be between 0.25 and 0.75, and preferably between 0.4 and 0.6, $h_f$ being the height of the front panel (FP) from the front-bottom edge (FBE) to the front-top edge (FTE). This provides for a particularly advantageous position of the transition between first section 102 and second section 103, discussed above, both in terms of providing an intuitively positioned grip section for a consumer and for providing the advantages discussed with respect to package robustness and ease of manipulating the shape of the package 100.

Figure 3A:
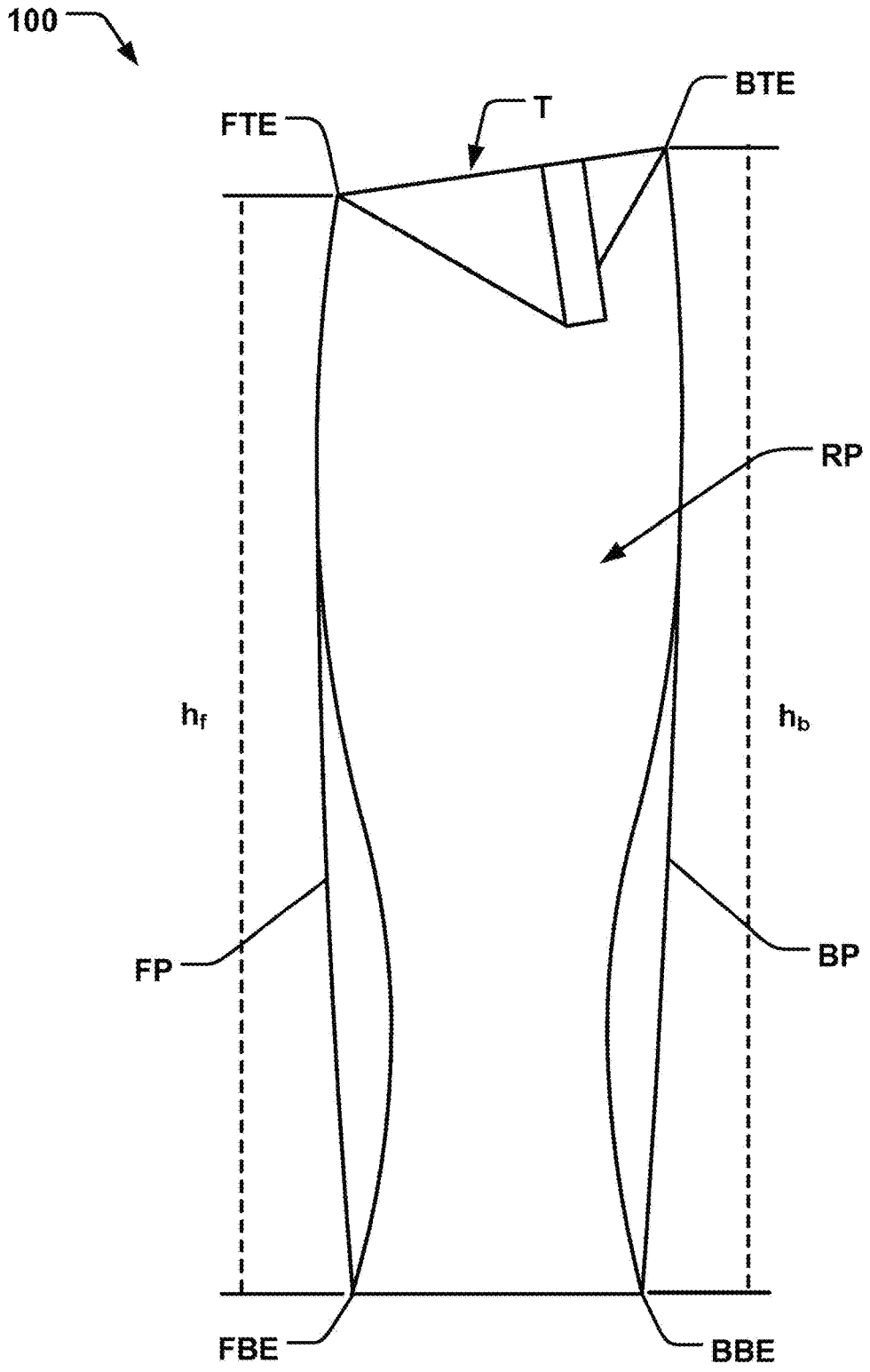
FIG. 3*a* is a schematic side view illustration of a right panel, a front panel, and a back panel of a container package, according to examples of the disclosure.

The back panel (BP) is connected to the top panel (T) along a back-top edge (BTE). The back panel (BP) is also connected to the bottom panel (B) along a back-bottom edge (BBE), as illustrated in FIG. 3*a*. As explained before, the height of the front panel (FP) from the front-bottom edge (FBE) to the front-top edge (FTE) is denoted $h_f$. The height of the back panel (BP) from the back-bottom edge (BBE) to the back-top edge (BTE) is denoted $h_b$. In the embodiment shown $h_b$ is greater than $h_f$. In particular, the ratio of $h_b/h_f$ may be at least 1.05. This provides for a slanted top panel (T), as seen in FIG. 3*a*. Such asymmetry may further facilitate manipulation of the shape of the package 100, such as compressing the package 100, since the front-top edge (FTE) and the back-top edge (BTE) are off-set with respect to each other, facilitating folding of the top panel (T) in a direction in which the top panel (T) is already tilting, when compressing the package 100.

The length ($L_B$) of the front-bottom edge (FBE) may be longer than the length ($L_T$) of the front-top edge (FTE), as exemplified in e.g. FIG. 1*a*. The bottom panel (B) may for example have a rectangular shape, while the top panel (T) may have a quadratic shape. This provides for increasing the larger width ($w_1$) further to provide an even more emphasized difference with respect to the smaller width ($w_2$).

The front-left edge (FLE) and/or the front-right edge (FRE) may have the form of a sinus curve, as illustrated in e.g. FIG. 1*a*. Such smooth curvature provides for a secure and comfortable grip of the package 100, e.g. at the second section 103.

Figure 3B:
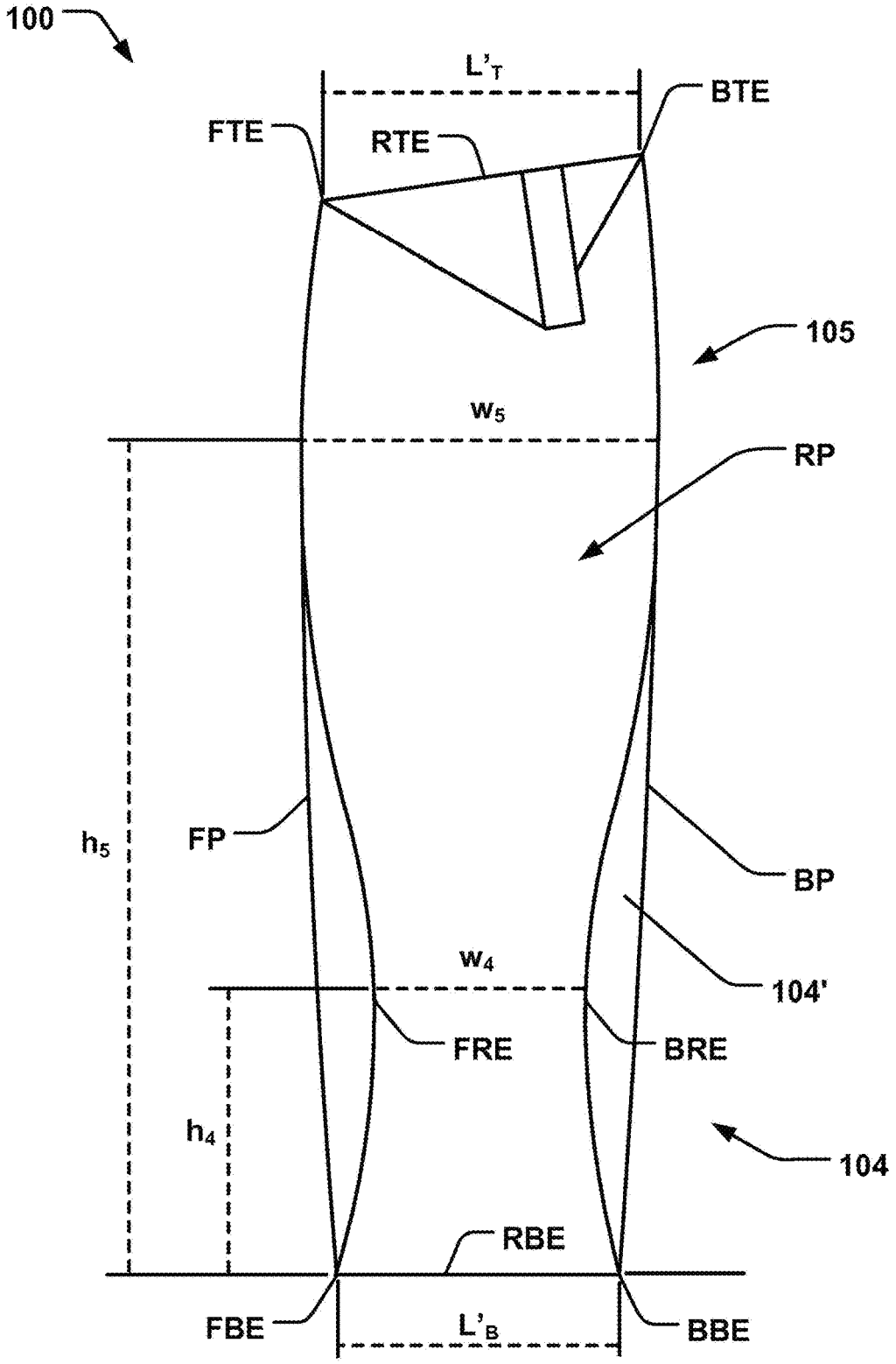
FIG. 3*b* is a schematic side view illustration of a right panel, a front panel, and a back panel of a container package, according to examples of the disclosure.

Also, the back-left edge (BLE) and/or the back-right edge (BRE) may have the form of a sinus curve. FIG. 3*b* illustrates the back-right edge (BRE) of the right panel (RP) having the form of a sinus curve. The back-left edge (BLE) may have a corresponding shape. The right panel (RP) is described in more detail below.

The shape of the back panel (BP) may be a mirror image of the shape of the front panel (FP). The back panel (BP) may also be mirror image of the shape of the front panel (FP) which is scaled in the height dimension according to a difference in the height ($h_f$) of the front panel (FP) and the height ($h_b$) of the back panel (BP). The back panel (BP) may thus have a corresponding shape as the front panel (FP), but being stretched in the height dimension.

Further, the front-right edge (FRE) may be a mirror image of the front-left edge (FLE), as illustrated in e.g. FIG. 1*a*. Such symmetry may provide for an increased robustness and stability of the package 100. Likewise, the back-right edge (BRE) may also be a mirror image of the back-left edge (BLE). The overall symmetry may provide for a more intuitive handling of the package 100.

An average length of the front-bottom edge (FBE) and the front-top edge (FTE) may be denoted as $w_a$. The ratio $(w_1-w_a)/w_a$ may be larger than the ratio $(w_a-w_2)/w_a$. Thus, the difference in length of the width ($w_1$) (i.e. the wider section 102) may be larger than the difference in length of the width ($w_2$) (i.e. the narrow section 103), with reference to the average length $w_a$.

The right panel (RP) is connected to the top panel (T) along a right-top edge (RTE) and further to the bottom panel (B) along a right-bottom edge (RBE), as illustrated in FIG. 3*b*. At a fourth height ($h_4$), measured from the right-bottom edge (RBE), the transversal width ($w_4$) of the right panel (RP) measured from the front-right edge (FRE) to the back-right edge (BRE) is smaller than a length ($L'_B$) of the right-bottom edge (RBE), and smaller than a length ($L'_T$) of the right-top edge (RTE). The length ($L'_T$) of the right-top edge (RTE) is in the example of FIG. 3*b* regarded as the distance between the back-top edge (BTE) and the front-top edge (FTE) projected on a plane perpendicular to the height direction. At a fifth height ($h_5$), measured from the right-bottom edge (RBE), the transversal width ($w_5$) of the right panel (RP) measured from the front-right edge (FRE) to the back-right edge (BRE) is larger than the length ($L'_B$) of the right-bottom edge (RBE), and larger than the length ($L'_T$) of the right-top edge (RTE). Thus, the right panel (RP) may have a varying width ($w_4$, $w_5$), providing for a section 104 of the right panel (RP) with a reduced width ($w_4$), and a section 105 of the right panel (RP) having an increased width ($w_5$). Having such varying widths ($w_4$, $w_5$) also for the right panel (RP) provides for further emphasizing the advantages described above with respect to the front panel (FP), to further improve ease of use, such as providing a better grip section, and facilitated compression of the package 100, while having robust properties of the overall package 100.

The fifth height ($h_5$) may be greater than the fourth height (ha), as illustrated in the example of FIG. 3*b*. The narrow section 104 of the right panel (RP), having width $w_4$, may thus be provided adjacent to the base of the package 100, while the narrow section 103 of the front panel (FP), having width $w_2$ (FIG. 1*a*), is provided adjacent to the top of the package 100. The displacement of the narrow sections ($w_2$, $w_4$) of adjacent side panels, in the height direction, provides for having associated sections 103, 104, with indentations arranged along the full height, where compression of the package 100 may be initiated in a facilitated manner. Also, a consumer may find an intuitive grip at sections 103, 104, i.e. both adjacent the base and the top of the package. FIG. 3*b* also illustrates beveled surfaces 104', which are similar to beveled surfaces 103' described in relation to FIG. 1*a*, but adjacent the base of the package 100, instead of the top.

Figure 3C:
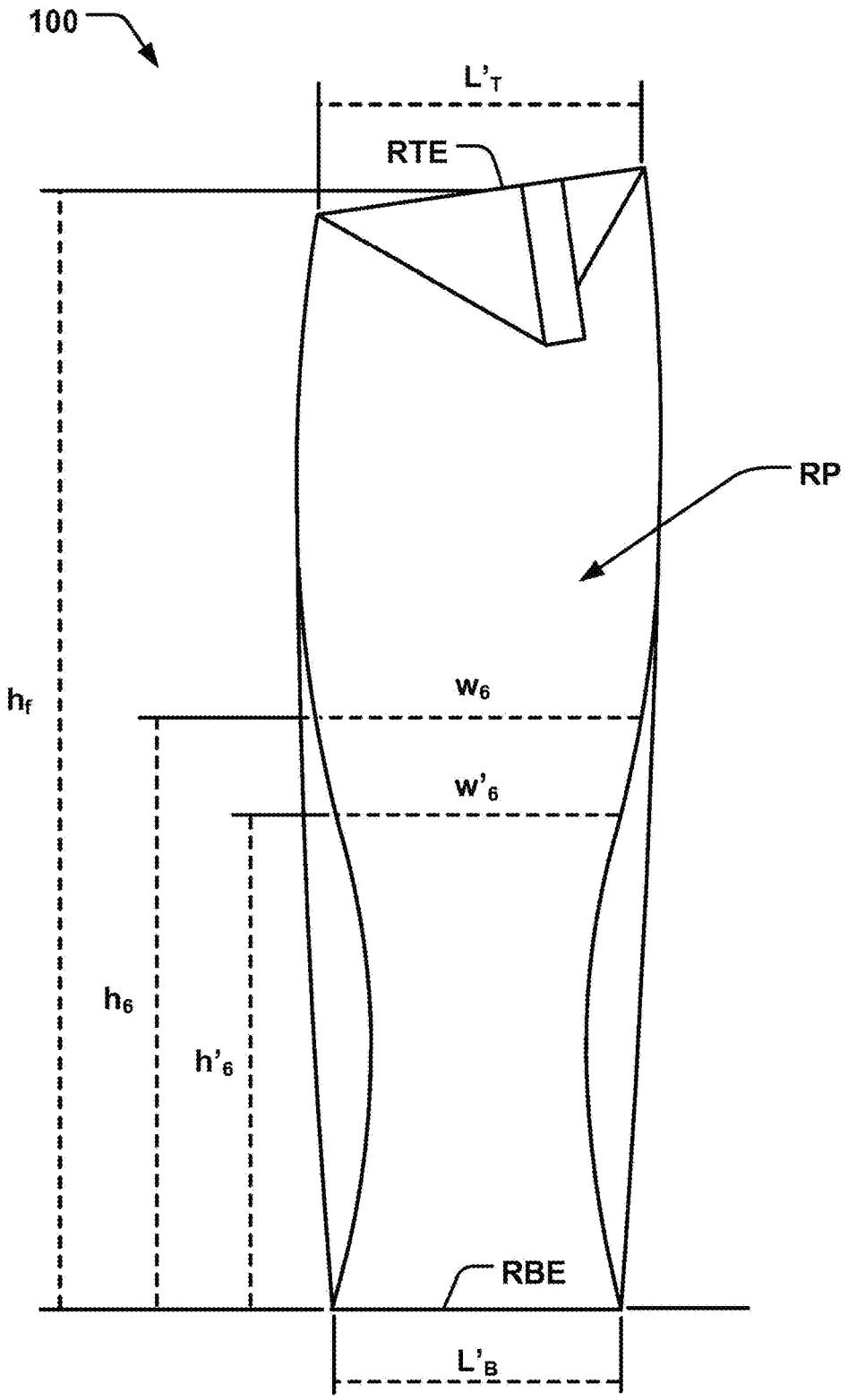
FIG. 3*c* is a schematic side view illustration of a right panel, a front panel, and a back panel of a container package, according to examples of the disclosure.

As described in relation to FIG. 1*b*, a transversal width ($w_6$, $w'_6$) of the right panel (RP) may be equal to the length ($L'_B$) of the right-bottom edge (RBE) or to the length ($L'_T$) of the right-top edge (RTE) at a height ($h_6$, $h'_6$), as schematically illustrated in FIG. 3*c*. The ratio $h_6/h_f$, or $h'_6/h_f$, may be between 0.25 and 0.75, and preferably between 0.4 and 0.6, $h_f$ being the height of the right panel (RP) from the right-bottom edge (RBE) to the center of the right-top edge (RTE).

The shape of the left panel (LP) may be a mirror image of the shape of the right panel (RP).

Figure 4A:
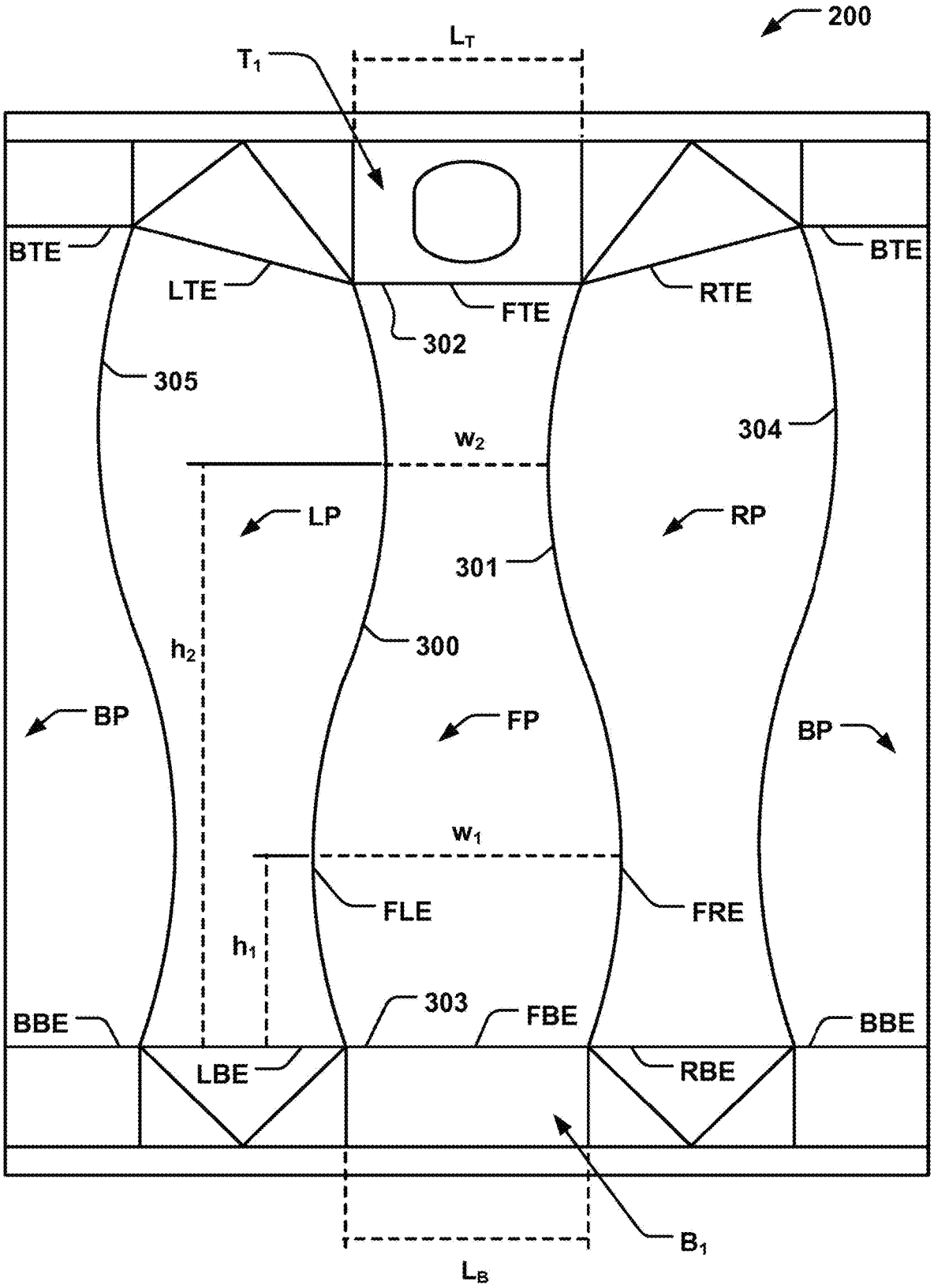
FIGS. 4*a-b* are schematic illustrations of a carton blank for a container package with a front panel section, a right panel section, a back panel section, and a left panel section, according to examples of the disclosure.
Figure 4B:
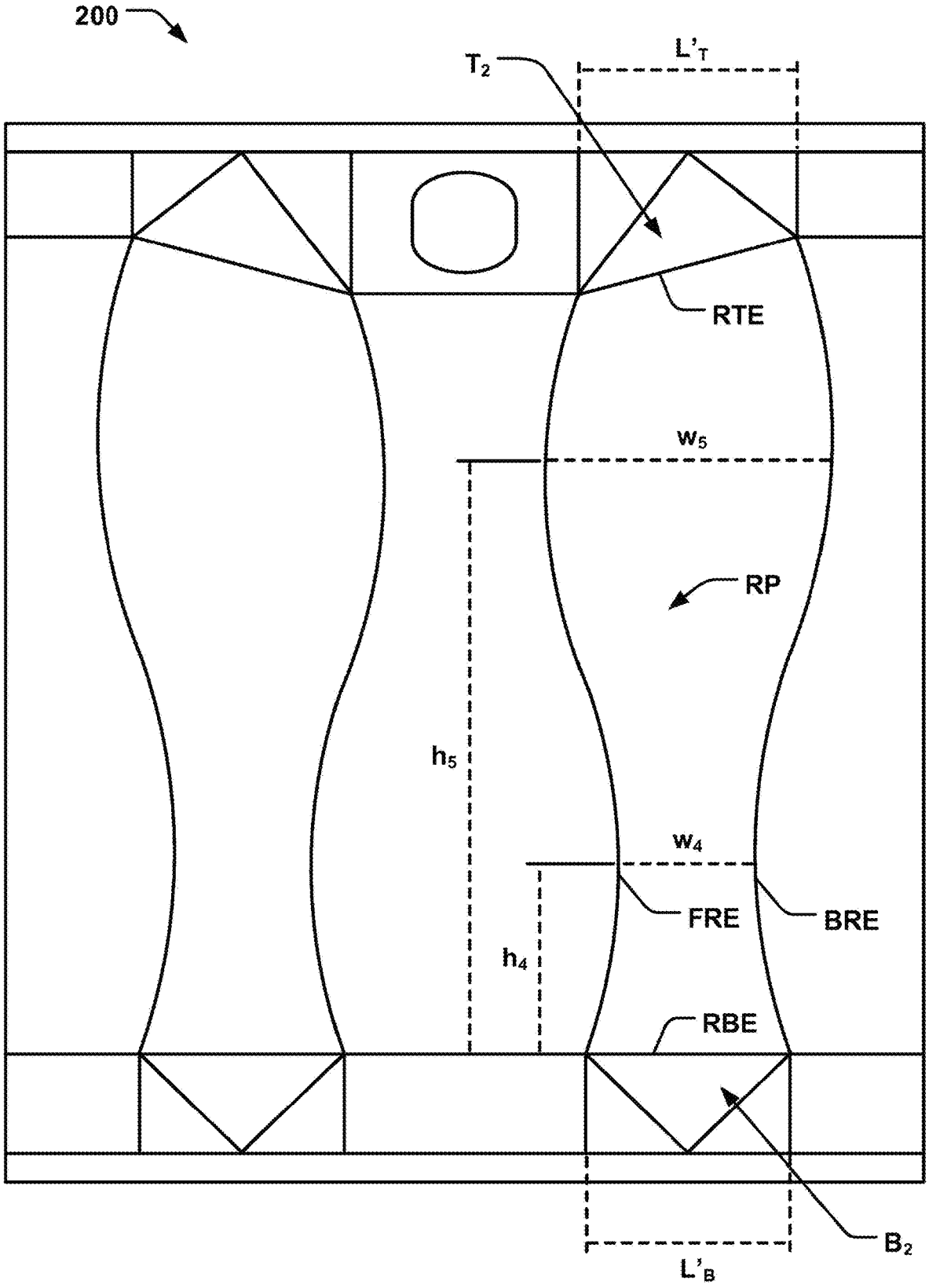

FIGS. 4*a*-4*b* are schematic illustrations of a carton blank 200 for a carton package 100. Turning first to FIG. 4*a*, the carton blank 200 comprises a first longitudinal crease line 300 defining a front-left edge (FLE) of the carton package 100, and a second longitudinal crease line 301 defining a front-right edge (FRE) of the carton package 100. The carton blank 200 comprises a first transversal crease line 302 defining a front-top edge (FTE), a back-top edge (BTE), a left-top edge (LTE), and a right-top edge (RTE) of the carton package 100. The carton blank 200 comprises a second transversal crease line 303 defining a front-bottom edge (FBE), a back-bottom edge (BBE), a left-bottom edge (LBE), and a right-bottom edge (RBE) of the carton package 100. The carton blank 200 comprises a front panel section (FP), a back panel section (BP), a left panel section (LP), and a right panel section (RP). The front panel section (FP) extends between the front-left edge (FLE) and the front-right edge (FRE) and is connected to a top panel section ($T_1$) along the front-top edge (FTE) and is connected to a bottom panel section ($B_1$) along the front-bottom edge (FBE). At a first height ($h_1$), measured from the front-bottom edge (FBE), the transversal width ($w_1$) of the front panel section (FP) measured from the front-left edge (FLE) to the front-right edge (FRE) is larger than a length ($L_B$) of the front-bottom edge (FBE), and larger than a length ($L_T$) of the front-top edge (FTE). At a second height ($h_2$), measured from the front-bottom edge (FBE), the transversal width ($w_2$) of the front panel section (FP) measured from the front-left edge (FLE) to the front-right edge (FRE) is smaller than the length ($L_B$) of the front-bottom edge (FBE), and smaller than the length ($L_T$) of the front-top edge (FTE).

The blank 200 thus provides for the advantageous benefits described above with respect to the package 100 and the front panel (FP) thereof.

As further shown in FIG. 4*a*, the carton blank 200 may comprise a third longitudinal crease line 304 defining the right panel section (RP) together with the second longitudinal crease line 301, the first transversal crease line 302, and the second transversal crease line 303. The carton blank 200 may also comprise a fourth longitudinal crease line 305 defining the left panel section (LP) together with the first longitudinal crease line 300, the first transversal crease line 302, and the second transversal crease line 303.

Turning to FIG. 4*b*, the right panel section (RP) may extend between the front-right edge (FRE) and back-right edge (BRE) and may be connected to a top panel section ($T_2$) along the right-top edge (RTE) and may be connected to a bottom panel section ($B_2$) along the right-bottom edge (RBE). At a fourth height ($h_4$), measured from the right-bottom edge (RBE), the transversal width ($w_4$) of the right panel section (RP) measured from the front-right edge (FRE) to the back-right edge (BRE) is smaller than a length ($L'_B$) of the right-bottom edge (RBE), and smaller than a length (L'T) of the right-top edge (RTE). At a fifth height ($h_5$), measured from the right-bottom edge (RBE), the transversal width ($w_5$) of the right panel section (RP) measured from the front-right edge (FRE) to the back-right edge (BRE) is larger than the length ($L'_B$) of the right-bottom edge (RBE), and larger than the length (L'T) of the right-top edge (RTE). The length ($L'_T$) of the right-top edge (RTE) is in the example of FIG. 4*b* regarded as the distance between the second longitudinal crease line 301 and the third longitudinal crease line 304 at the right-top edge (RTE). The blank 200 thus further provides for the advantageous benefits described above with respect to the package 100 and the right panel (RP) thereof.

The present invention has been described above with reference to specific examples. However, other examples than the above described are equally possible within the scope of the invention. The different features and steps of the invention may be combined in other combinations than those described. The scope of the invention is only limited by the appended patent claims.

More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used.

The invention claimed is:

1. A carton package for liquid consumables comprising a top panel;

a bottom panel;

a body extending between the top panel and the bottom panel, the body comprising:

a front panel having a transversal width, a back panel, a left panel, and a right panel separated by four edges: front-left edge, front-right edge, back-left edge, back-right edge, wherein each of the front panel, back panel, left panel, and right panel and four edges extends from the top panel to the bottom panel, wherein the front panel is connected to the top panel along a front-top edge and is connected to the bottom panel along a front-bottom edge, the front-bottom edge having a length, the front-top edge having a length, at a first height measured from the front-bottom edge, the transversal width of the front panel measured from the front-left edge to the front-right edge is larger than the length of the front-bottom edge, and larger than the length of the front-top edge, at a second height measured from the front-bottom edge, the transversal width of the front panel measured from the front-left edge to the front-right edge is smaller than the length of the front-bottom edge, and smaller than the length of the front-top edge, the back panel being connected to the top panel along a back-top edge and being connected to the bottom panel along a back-bottom edge, $h_f$ being a height of the front panel from the front-bottom edge to the front-top edge, $h_b$ being a height of the back panel from the back-bottom edge to the back-top edge, and the height $h_b$ being greater than the height $h_f$.

2. A carton package according to claim 1, wherein the second height is greater than the first height.

3. A carton package according to claim 1, wherein the transversal width of the front panel is equal to the length of the front-bottom edge or to the length of the front-top edge at a height ($h_3$, $h'_3$), wherein a ratio $h_3/h_f$, or $h'_3/h_f$, is between 0.25 and 0.75, wherein $h_f$ is a height of the front panel from the front-bottom edge to the front-top edge.

4. A carton package according to claim 1, wherein the length of the front-bottom edge is longer than the length of the front-top edge.

5. A carton package according to claim 1, wherein the front-left edge and/or the front-right edge have the form of a sinus curve.

6. A carton package according to claim 1, wherein the back-left edge and/or the back-right edge have the form of a sinus curve.

7. A carton package according to claim 1, wherein a shape of the back panel is a mirror image of the shape of the front panel which is scaled in the height dimension according to a difference in heights between the front and back panel.

8. A carton package according to claim 1, wherein the front-right edge is a mirror image of the front-left edge.

9. A carton package according to claim 1, wherein $w_a$ is an average length of the front-bottom edge and the front-top edge, wherein the ratio $(w_1-w_a)/w_a$ is larger than the ratio $(w_a-w_2)/w_a$.

10. A carton package according to claim 1, wherein the right panel is connected to the top panel along a right-top edge and is connected to the bottom panel along a right-bottom edge, wherein at a fourth height measured from the right-bottom edge, a transversal width of the right panel measured from the front-right edge to the back-right edge is smaller than a length of the right-bottom edge, and smaller than a length of the right-top edge, and at a fifth height measured from the right-bottom edge, a transversal width of the right panel measured from the front-right edge to the back-right edge is;

larger than the length of the right-bottom edge, and larger than the length of the right-top edge.

11. A carton package according to claim 10, wherein the fifth height is greater than the fourth height.

12. A carton package according to claim 10, wherein a transversal width of the right panel is equal to the length of the right-bottom edge or to the length of the right-top edge at a height, wherein a ratio $h_6/h_f$, or $h'_6/h_f$, is between 0.25 and 0.75, wherein $h_f$ is a height of the right panel from the right-bottom edge to a center of the right-top edge.

13. A carton package according to claim 10, wherein a shape of the left panel is a mirror image of a shape of the right panel.

14. A carton package according to claim 10, wherein a transversal width of the right panel is equal to the length of the right-bottom edge or to the length of the right-top edge at a height, wherein a ratio $h_6/h_f$, or $h'_6/h_f$, is between 0.4 and 0.6, wherein $h_f$ is a height of the right panel from the right-bottom edge to a center of the right-top edge.

15. A carton package according to claim 1, wherein the transversal width of the front panel is equal to the length of the front-bottom edge or to the length of the front-top edge at a height, and the ratio $h_3/h_f$, or $h'_3/h_f$, is between 0.4 and 0.6, wherein $h_f$ is the height of the front panel from the front-bottom edge to the front-top edge.

16. A carton blank for a carton package, comprising a first longitudinal crease line defining a front-left edge of said carton package, a second longitudinal crease line defining a front-right edge of said carton package, a first transversal crease line defining a front-top edge, a back-top edge, a left-top edge, and a right-top edge of said carton package, a second transversal crease line defining a front-bottom edge, a back-bottom edge, a left-bottom edge, and a right-bottom edge of said carton package, the front-bottom edge having a length, the front-top edge having a length, a front panel section, a back panel section, a left panel section, and a right panel section, the front panel section having a transversal width, wherein the front panel section extends between the front-left edge and the front-right edge and is connected to a top panel section along the front-top edge and is connected to a bottom panel section along the front-bottom edge, at a first height measured from the front-bottom edge, the transversal width of the front panel section measured from the front-left edge to the front-right edge is larger than the length of the front-bottom edge, and larger than the length of the front-top edge, at a second height measured from the front-bottom edge, the transversal width of the front panel section measured from the front-left edge to the front-right edge is smaller than the length of the front-bottom edge, and smaller than the length of the front-top edge;

the back panel section extends along the front-left edge and is connected to the top panel section along a back-top edge and is connected to the bottom panel section along a back-bottom edge, $h_f$ being a height of the front panel section from the front-bottom edge to the front-top edge, $h_b$ being a height of the back panel section from the back-bottom edge to the back-top edge, and the height $h_b$ being greater than the height $h_f$.

17. A carton blank according to claim 16, comprising a third longitudinal crease line defining the right panel section together with the second longitudinal crease line, the first transversal crease line, and the second transversal crease line.

18. A carton blank according to claim 16, comprising a fourth longitudinal crease line defining the left panel section together with the first longitudinal crease line, the first transversal crease line, and the second transversal crease line.

19. A carton blank according to claim 16, wherein the right panel section extends between the front-right and back-right edges and is connected to a top panel section along the right-top edge and is connected to a bottom panel section along the right-bottom edge, the right panel section having a transversal width, the right-bottom edge having a length, the front-top edge having a length, wherein at a fourth height measured from the right-bottom edge, the transversal width of the right panel section measured from the front-right edge to the back-right edge is;

smaller than the length of the right-bottom edge, and smaller than the length of the right-top edge, and at a fifth height measured from the right-bottom edge, the transversal width of the right panel section measured from the front-right edge to the back-right edge is; larger than the length of the right-bottom edge, and larger than the length of the right-top edge.

* * * * *